US005642623A

United States Patent [19]

Hiresaki et al.

[11] Patent Number: 5,642,623

[45] Date of Patent: Jul. 1, 1997

[54] GAS CYCLE REFRIGERATOR

[75] Inventors: Yu Hiresaki; Jin Lin Gao, both of Tokyo; Yoichi Matsubara, Funabashi, all of Japan

[73] Assignee: Suzuki Shokan Co., Ltd., Tokyo, Japan

[21] Appl. No.: 554,322

[22] Filed: Nov. 2, 1995

[30] Foreign Application Priority Data

Feb. 23, 1995 [JP] Japan ..... 7-035276

[51] Int. Cl.[6] ..... F25B 9/00

[52] U.S. Cl. ..... 62/6; 62/467

[58] Field of Search ..... 62/6, 467

[56] References Cited

U.S. PATENT DOCUMENTS

| | | | |
|---|---|---|---|
| 3,902,328 | 9/1975 | Claudet | 62/6 |
| 5,181,383 | 1/1993 | Goto et al. | 62/6 |
| 5,435,136 | 7/1995 | Ishizaki et al. | 62/6 X |
| 5,440,883 | 8/1995 | Harada | 62/6 |
| 5,487,272 | 1/1996 | Nagao | 62/6 |

OTHER PUBLICATIONS

Abstract JP 06–229641, APS Grp No M1708, vol. No. 18, No 611, pub date Nov. 21, 1994, "Heat Pump of Inverted Sterling Cycle".

*Primary Examiner*—Christopher Kilner
*Attorney, Agent, or Firm*—Lowe, Price, LeBlanc & Becker

[57] ABSTRACT

A multi-staged gas cycle refrigerator having a first stage regeneration part including a compression piston, a second stage regeneration part including a double inlet pulse tube and a buffer is described. Temperatures below 10K are achieved without leakage of refrigerant gas, this configuration resulting in the improvement of efficiency and reduction of cost.

14 Claims, 11 Drawing Sheets

GAS CYCLE REFRIGERATOR

BACKGROUND OF THE INVENTION

1. Technical Field

The present invention relates to a gas cycle refrigerator which generates refrigeration by expanding refrigerant gas, for example, Helium, and refrigerates a substance to be cooled to a cryogenic temperature of 3 to 70K (Kelvin).

2. Background Art

In recent years, the number of superconducting magnet systems and detectors have increased which require cryogenic refrigeration within the temperature range of liquid Helium. A liquid Helium refrigeration device has many inconveniences as a cryogenic refrigerator used for the above purpose, and refrigerators of the type which vary the volume of an expansion room with the movement of a piston (including a displacer) provided in a cylinder, for example, a G-M (Gifford-McMahon) cycle refrigerator and a Stirling cycle refrigerator, and a pulse tube refrigerator which eliminates moving parts such as a piston or the like, are mainly used.

These conventional refrigerators can normally only refrigerate down to about 70K in the first stage; therefore, a multiple stage configuration of about 2 or 3 stages to improve refrigeration performance is required when refrigeration to lower temperature is needed.

One type of refrigerator varies the volume of the expansion room with the movement of the piston (displacer), expanding Helium gas to generate refrigeration. The volume of the expansion room varies with the movement of the piston inside the cylinder, charging and discharging Helium gas inside the expansion room to achieve the desired temperature.

For this reason, the opening between the cylinder and piston requires a seal preventing Helium gas from escaping the inside of the expansion room. A gas cycle refrigerator typically uses a non-lubricant type seal, for example, polytetrafluoroethylene (hereinafter described as "Teflon" (Trademark)), overcoming the problem of lubricant hardening at very low temperatures.

While a first stage refrigerator doesn't have the problem of the seal material contracting or otherwise leaking because the seal can be provided at a hot (room temperature) end of the piston which has little variation of temperature, a second stage refrigerator has various problems because the part where the seal is provided has a large variation of temperature (from room temperature to cryogenic temperature).

When there is little temperature fluctuation, a metal ring is sheathed with "Teflon", for example, a Teflon O ring, for the seal in the room temperature part. The seal to be provided in the part having thermal fluctuation requires a special metal ring with only its outer perimeter provided with "Teflon", and both the metal ring and "Teflon" are step cut because the thermal contraction rate of the metal ring and the "Teflon" are different.

There is a fear that refrigeration performance will be lowered by refrigerant gas leakage because the cut of the seal and the inside of the seal where the metal ring rubs the piston can't be completely sealed, as well as a fear that the cost of the seal will be high.

A pulse tube refrigerator which eliminates moving parts such as the piston has an advantage of not having a sealing problem. However, the application was delayed for a long time because the refrigeration performance could not be improved. Optimization for the single stage pulse tube refrigerator has been achieved recently through experimentation, and the refrigerator with high refrigeration efficiency has been put to actual applications.

However, the pulse tube refrigerator also requires multiple staging to lower the refrigeration temperature further. Multiple staging causes mutual interference between each stage part, requiring large-scale experiments for optimization. Thus, there is a problem of not being able to improve the refrigeration efficiency and the difficulty in optimization.

It is an object of the present invention to provide a gas cycle refrigerator having a multiple stage configuration and improved the refrigeration performance.

DISCLOSURE OF THE INVENTION

A gas cycle refrigerator of the present invention is made having a multiple stage configuration including at least 2 stages of refrigeration, a first stage refrigeration part and a second stage refrigeration part. The first stage refrigeration part includes a first stage regenerator where refrigerant gas is supplied, a cylinder connected to a cold end of the first stage regenerator, that is, to a port where the temperature of the gas becomes lower of the 2 ports where the refrigerant gas is supplied, and provided inside this cylinder is a piston which varies the volume of expansion room formed inside the cylinder. The second stage refrigeration part includes a tube connected to a cold end of a second stage regenerator, that is, the end opposite to a hot end connected to the first stage regenerator.

Additionally, the piston of the present invention includes a displacer which moves without compressing the inside of the cylinder.

It is desirable that the gas cycle refrigerator of the present invention has the second stage refrigeration part of a double inlet type, wherein the hot end of the second stage regenerator of the second stage refrigeration part and the hot end of the pulse tube are both connected to a buffer.

It is also desirable that, in the second stage refrigeration part, that the hot end of the second stage regenerator, the hot end of the pulse tube, and the buffer are connected so that the flow is adjustable by valves and orifices. Additionally, the flow may be set by properly selecting the internal diameter of the pulse tube, the size of the pulse tube or the target refrigeration temperature without providing valves or orifices.

In another embodiment of the present invention, only the buffer is connected to the hot end of the pulse tube of the second refrigeration part. It is also desirable that the hot end of the pulse tube of the second stage refrigeration part and the buffer are connected in such a way that the flow is either adjustable by valves and orifices, or by adjusting the internal diameter of the tube.

Furthermore, it is desirable that the hot end of the first stage regenerator of the first stage refrigeration part and a hot end of the cylinder are also connected.

It is also desirable that the refrigerant gas is one which is supplied by a generator for varying refrigerant gas pressure of the Gifford-McMahon (G-M) cycle type, consisting of a compressor, a high pressure valve and a low pressure valve to vary refrigerant gas pressure between high pressure and low pressure. The generator for varying refrigerant gas pressure of the so-called Stirling type may also be used, consisting of a compression piston or the like and varying refrigerant gas pressure between high pressure and low pressure.

The first stage regenerator may be concentrically provided inside the piston. The pulse tube may also be one which is concentrically provided inside the second stage regenerator.

In the present invention, the first stage refrigeration part consists of the first stage regenerator, the cylinder and the piston. The second stage refrigeration part consists of the second stage regenerator and the pulse tube. The first stage and second stage refrigeration parts form a multiple stage refrigerator with improved performance.

The first stage refrigeration part varies the volume of the expansion room within the piston, similar to the conventional G-M cycle refrigerator, requiring a seal in the piston part. Teflon can be used for this piston seal because the seal can be provided at the hot end of the first stage refrigeration part (the room temperature end); therefore, the piston part can be sealed for a low price.

In this manner, problems in the second stage refrigeration part caused by providing the seal in the cold part, as in the G-M cycle refrigerator, can be avoided when using a 2 staged refrigerator.

Moreover, because the first stage refrigeration part varies the volume of the expansion room with the movement of the piston, the pressure fluctuation of the refrigerant gas at the low temperature end of the first stage regenerator can be clearly analyzed. Thus, the second stage refrigeration part can be regarded as having the same operation as that of a conventional single stage pulse tube refrigerator, and the refrigeration performance can be optimized.

BEST MODE FOR CARRYING OUT THE INVENTION

A preferable embodiment of the present invention will be described below with reference to the drawings.

Figure 1:
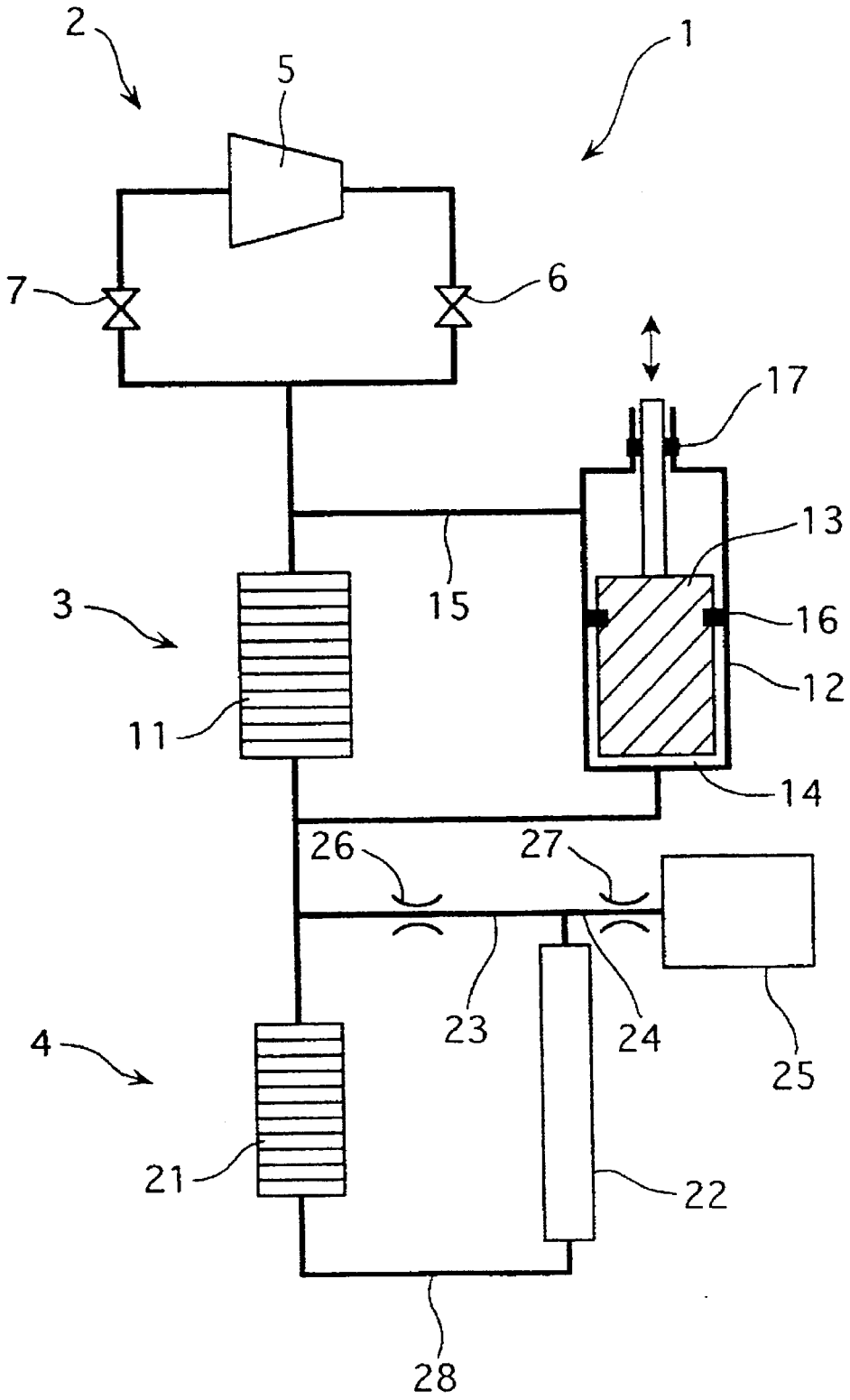
FIG. 1 is a block diagram showing a gas cycle refrigerator of one embodiment of the present invention.

FIG. 1 illustrates a block diagram of a gas cycle refrigerator 1 of the present invention. The gas cycle refrigerator 1 includes a generator 2 for varying refrigerant gas pressure, a first stage refrigeration part 3, and a second stage refrigeration part 4.

The generator 2 for varying refrigerant gas pressure consists of a compressor 5, a high pressure valve 6 positioned at the high pressure end of the compressor 5, and a low pressure valve 7 positioned at the low pressure end of the compressor 5. The generator 2 is constructed to supply a refrigerant gas, for example, helium, while the pressure of the gas is varied by the opening and closing of the valves 6 and 7.

The first stage refrigeration part 3 includes a first regenerator 11 connected to the compressor 5 through each of the valves 6 and 7 a cylinder 12 connected to a cold end (in FIG. 1 the lower end, that is, the end opposite to the end connected to the compressor 5) of the first stage regenerator 11, and a piston (displacer) 13 provided inside cylinder 12. The piston 13 is connected to and reciprocated by a motor which is not illustrated in the drawings.

Inside the cylinder 12, an expansion room 14 is formed by the space at the cold end (in FIG. 1, the lower end, that is, the end connected to a cold end of the regenerator 11) of the piston 13. A hot end (the end opposite to the expansion room 14) of the cylinder 12 is connected to a hot end of the first stage regenerator 11 by a tube 15.

Seals 16 and 17 are O rings of a non lubricant type, for example, "Teflon" (Trademark), and are provided to seal the clearance between the piston 13 and the cylinder 12 by rubbing against the inside of the cylinder 12.

The second stage refrigeration part 4 includes a second stage regenerator 21 connected to the cold end of the first stage regenerator 11, and a pulse tube 22 connected to a cold end (in FIG. 1, the lower end, that is, the end opposite to the end connected to the first stage regenerator 11) of this second stage regenerator 21. The capacity of the first stage regenerator 11 is made to be larger than that of the second stage regenerator 21 because the first stage regenerator 11 is cooled by not only the refrigerant gas cooled in the first stage refrigeration part 3, but also by the refrigerant gas from the second stage refrigeration part 4, while only the second stage regenerator 21 is operated in the second stage refrigeration part 4.

A hot end (in FIG. 1, the upper end, that is, the end opposite to the end connected to a cold end of the second stage regenerator 21) of the pulse tube 22 is connected to a hot end of the second stage regenerator 21 through a bypass tube 23. The hot end of the pulse tube 22 is connected to a buffer 25 through a tube 24.

Flow (flow resistance) through the bypass tube 23 and the tube 24 is adjusted with orifices 26 and 27, or by properly selecting the internal diameters of both the bypass tube 23 and the tube 24. Accordingly, the pulse tube 22 is a double inlet type to which the bypass tube 23 and the tube 24 are connected which have orifices 26 and 27 as a second phase control mechanism.

A heat station 28, where the substance to be cooled is refrigerated, is formed by the second stage regenerator 21 and a cold end part of the pulse tube 22.

Figure 2:
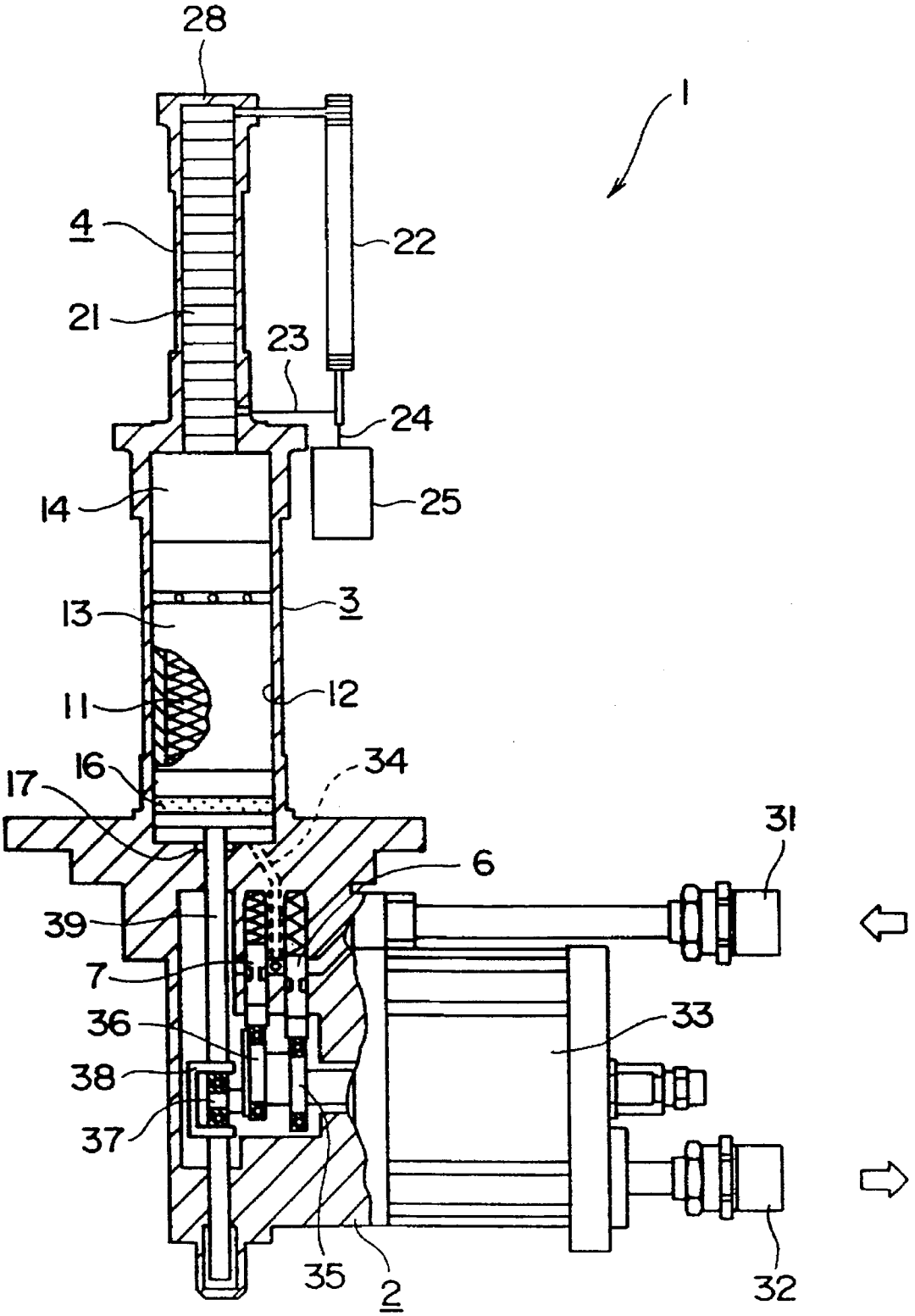
FIG. 2 is a vertical sectional view of an example of the embodiment applied to the gas cycle refrigerator in a cryopump.

FIG. 2 illustrates the gas cycle refrigerator to be included in a cryopump. Here, the gas cycle refrigerator 1 is arranged such that the generator 2 for varying refrigerant gas pressure is provided at the lowest end, along with the first stage refrigeration part 3, and the second stage refrigeration part 4 is provided at the highest stage.

The generator 2 for varying refrigerant gas pressure includes a joint 31 connected to the high pressure end of compressor 5 (not described in FIG. 2), a joint 32 connected to the low pressure end, and a drive motor 33. The joint 31 is connected to the cylinder 12 of the first stage refrigeration part 3 through an air passage 34, this flow passage arranged as to be opened and closed by the high pressure valve 6 which is slid by a cam 35 located on the output shaft of the motor 33.

Air passage 34 is connected to the joint 32 through the space where the output shaft of the motor 33 is located, and this flow passage is so arranged as to be opened and closed by the low pressure valve 7. The low pressure valve 7 is opened and closed by a cam 36 located at the output shaft of the motor 33.

The forward end of the output shaft of the motor 33 is made to be a crank 37, which is engaged by a scotch yoke 38 by which the shaft 39 is moved up and down, thereby moving the piston 13 inside the cylinder 12 up and down. Accordingly, the drive of the piston 13 and the drives of the high pressure valve 6 and the low pressure valve 7, that is, the pressure fluctuation cycles of refrigerant gas, are synchronized.

The first stage regenerator 11 is within piston 13, the regenerator 11, the air passage 34, and the expansion room 14 above the piston 13 are therefore co-located. Even when the regenerator 11 is arranged inside the piston 13, the block diagram is the same as illustrated in FIG. 1 with the air passage 34, at the high pressure valve 6 end, connected with the regenerator 11 and the hot end (in FIG. 2, the lower end) of the piston 13, and further connected with the expansion room 14 through the regenerator 11.

The second stage regenerator 21 of the second stage refrigeration part 4 is arranged on the expansion room 14 in the cylinder 12, and a hot end (the lower end adjacent the expansion room 14) and a cold end (the upper end) of this regenerator 21 are respectively connected with the hot end (the lower end) and the cold end (the upper end) of the pulse tube 22. The buffer 25 is connected to the hot end of the pulse tube 22. The heat station 28 is formed by the upper end of the second stage refrigeration part 4.

The refrigerating operation in the gas cycle refrigerator 1 arranged according to FIG. 2 will be described with reference to FIGS. 3(A) and 3(B) and 4(A) and 4(B).

Figure 3A:
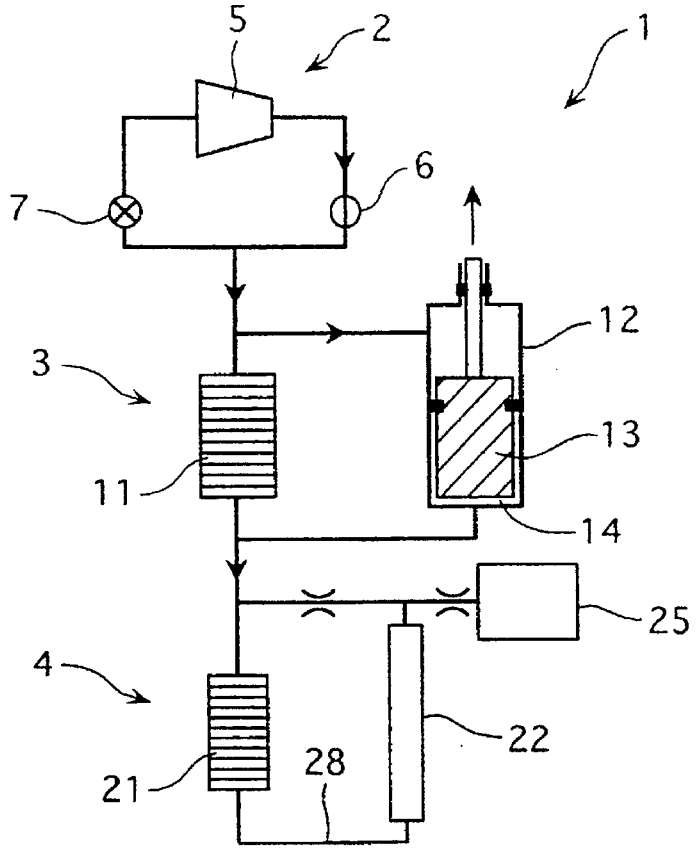
FIG. 3(A) and 3(B) are diagrams depicting the operation of the gas cycle refrigerator of the embodiment.

As FIG. 3(A) illustrates, when the high pressure valve 6 is opened while the piston 13 is at the cold end, the pressure inside both the first refrigeration part 3 and the second refrigeration part 4 increases.

Figure 3B:
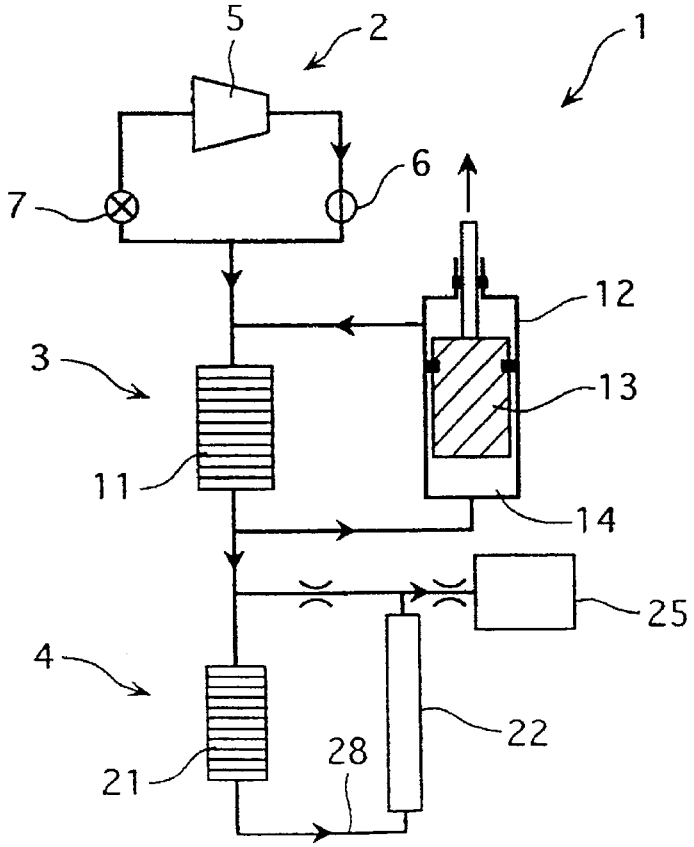

In FIG. 3(B), when the volume of the expansion room 14 is increased by moving the piston 13 in the first refrigeration part 3, the refrigerant gas, cooled by passing the gas through the first stage regenerator 11, moves into the expansion room 14. Meanwhile, in the second refrigeration part 4, high-pressure gas is cooled by passing the gas through the first stage regenerator, and is further cooled by passing the gas through the second regenerator 21 and moving the gas into the pulse tube 22.

Figure 4A:
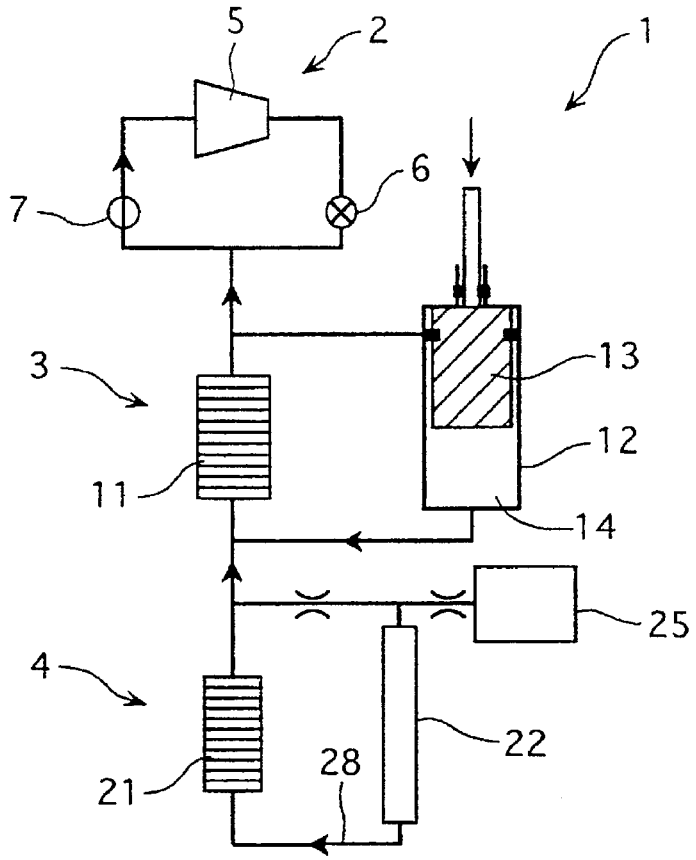
FIG. 4(A) and 4(B) are diagrams depicting the operation of the gas cycle refrigerator of the embodiment.

As FIG. 4(A) illustrates, when the low pressure valve 7 is opened while the high pressure valve 6 is closed, the pressure of the hot end of the first stage regenerator 11 decreases, so that the gas inside the expansion room 14 expands and returns to the first stage regenerator 11. Thus, refrigeration is generated by expansion, the gas becomes cryogenic, and the first stage regenerator 11 is cooled by this gas returning to the low pressure valve 7 end. Meanwhile, because the pressure at the hot end of the second stage regenerator 21 also becomes low in the second stage refrigeration part 4, the gas inside the pulse tube 22 expands and generates refrigeration, cooling the substance to be refrigerated while returning the gas to the first stage regenerator 11 end and to the low pressure valve 7 end, the helium gas further cooling the second stage regenerator 21.

Figure 4B:
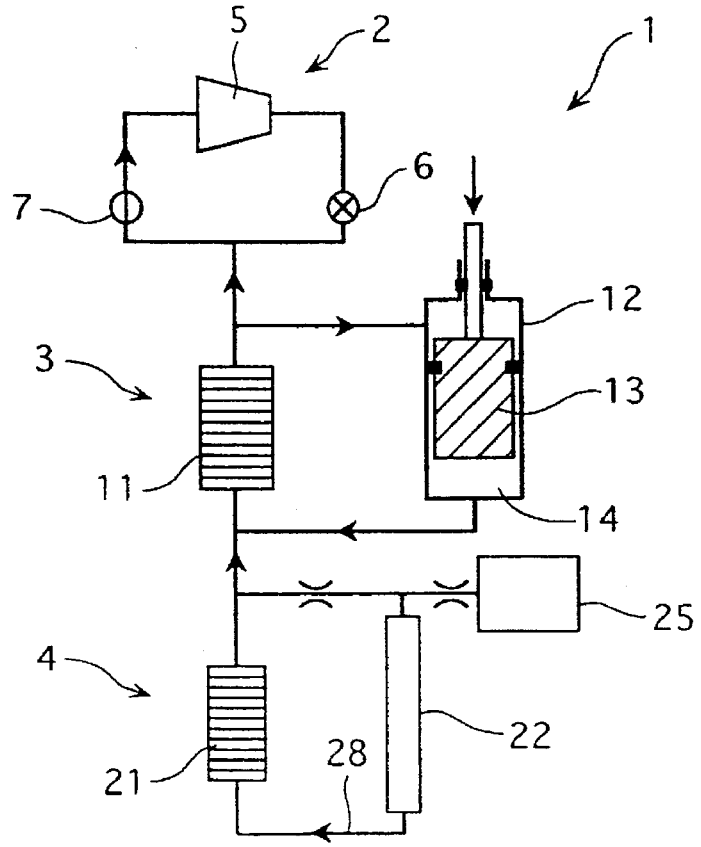

In FIG. 4(B), the piston 12 is moved downward, returning to the state illustrated in FIG. 3(A).

By repeating the operation described above, the temperature at the cold ends of the first stage regenerator 11 and the second stage regenerator 21 are successively lowered, and the heat station 28 at the second stage regenerator 21 has the cryogenic temperature of about 4K, enhancing the refrigeration performance.

The gas cycle refrigerator embodiment is made to be two-staged, and the minimum attainable temperature at the second stage refrigeration part 4 can be made to be the cryogenic temperature of about 4K. For example, by using regenerator materials such as Er3Ni (Erbium 3 Nickel) for the second stage regenerator 21, refrigeration performance can be improved.

For this reason, the gas cycle refrigerator 1 can be used when refrigeration to cryogenic temperature is required, for example, the cryopump, and can be applied to various uses, machinery and devices which require cryogenic refrigeration.

Since the second stage refrigeration part 4 which is to be cryogenic has the refrigeration part of the pulse tube method with no moving parts, there is no need to provide the seal at the cold part (thermal fluctuation part) like in the two-stage G-M cycle refrigerator; therefore, various problems caused by providing the seal at the cold part are avoided. For example, problems of the cost being high because of the high-cost seal required to cope with the thermal fluctuation, and the difficulty of secure sealing because of the seal contracting and expanding due to thermal fluctuation, are avoided. For these reasons, the gas cycle refrigerator 1 can be provided at a low price and can prevent the loss of refrigeration performance since the refrigerating operation can be reliably performed without any leakage of refrigerant gas.

Furthermore, the pressure fluctuation of the refrigerant gas supplied to the second stage refrigeration part 4 can be clearly analyzed because the first stage refrigeration part 3 varies the volume of the expansion room 14 in the same way as the conventional G-M cycle does. Therefore, the refrigerating operation of the second stage refrigeration part 4 using the pulse tube 22 can be regarded as the same as that of a single-stage pulse tube refrigerator, and the size of the pulse tube 22 and throttle (the flow of the gas) at the by-pass tube 23 and the tube 24 can be optimized, further improving the refrigeration performance of the gas cycle refrigerator 1.

When the generator 2 consists of the compressor 5, and valves 6 and 7, refrigerant gas can be steadily supplied at fixed pressure, so that the refrigeration performance of the gas cycle refrigerator 1 can be also improved in this respect.

Moreover, because the first stage regenerator 11 and the cylinder 12 are connected by the tube 15 in the embodiment, the gas inside cylinder 12 is discharged through tube 14 without being compressed when the piston 13 moves, effectively decreasing the driving power of the piston 13. For this reason, the piston 13 can be driven by a small-sized motor 33, and the whole body of the gas cycle refrigerator 1 can be made compact.

Since the second stage regenerator 21 and the pulse tube 22 are connected by the bypass tube 23, and the buffer 25 is connected to the hot end of the pulse tube 22 in this embodiment, the refrigeration performance in the second refrigeration part 4 is further improved.

The preferred embodiments of the invention have been described above; however, it is to be understood that the present invention is not intended to be limited to the above-described embodiments, and various improvements and changes of the design may be made therein without departing from the spirit of the present invention.

Figure 5:
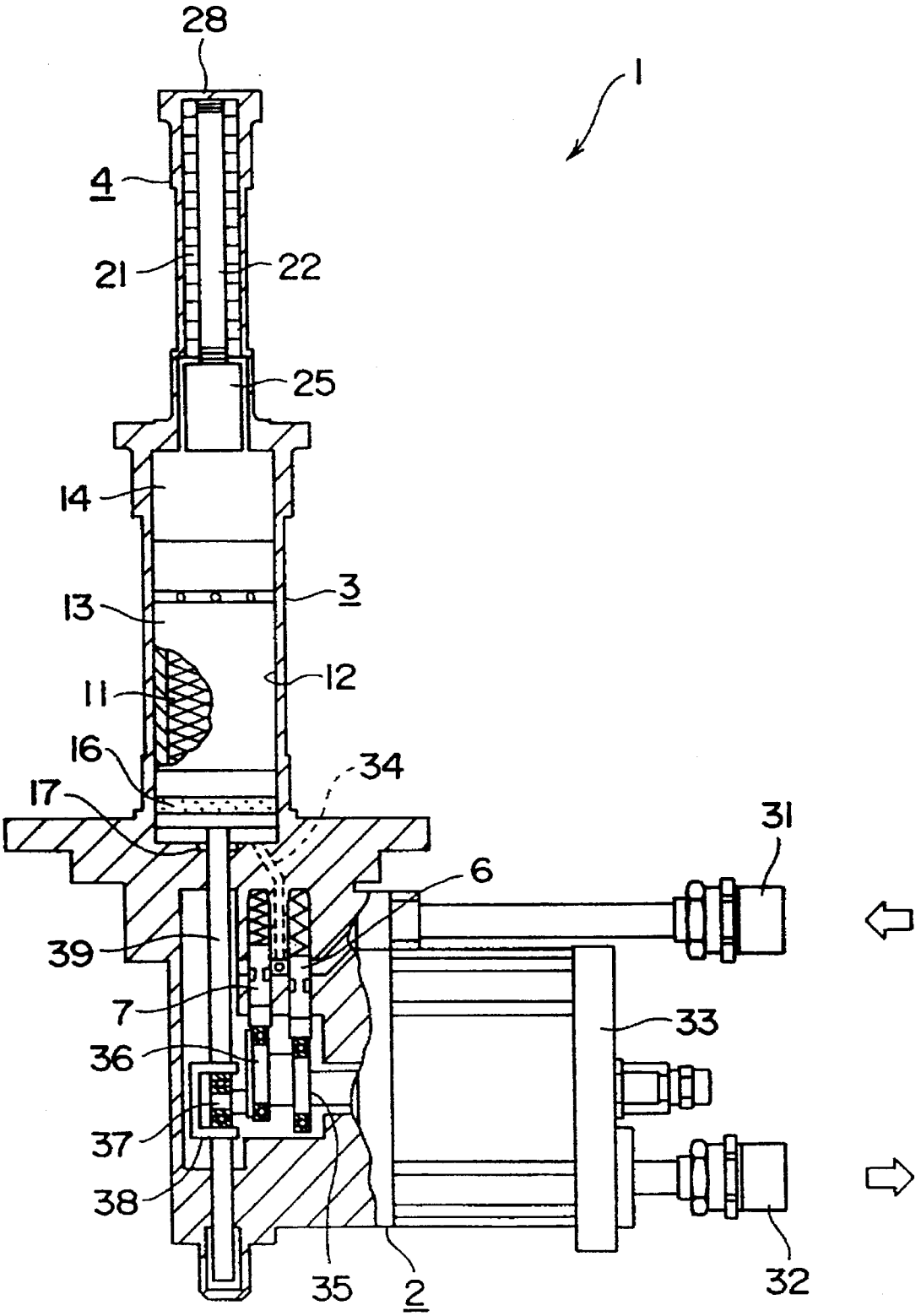
FIG. 5 is a vertical sectional view depicting a modification of the gas cycle refrigerator of the present invention.

For example, as for the gas cycle refrigerator 1, the pulse tube 22 may be arranged inside the second stage regenerator 21, and the buffer 25 may be arranged between the second stage regenerator 21 and the expansion room 14, illustrated in FIG. 5. Doing so has advantages of making the installation space for the gas cycle refrigerator 1 small and of realizing further miniaturization.

The arrangement, size, and configuration of each regenerator 11 and 21, the piston 13, and the pulse tube 22 may be appropriately set up according to the use of each gas cycle refrigerator 1, provided that they are corresponding to the arrangement illustrated in FIG. 1.

The arrangement of the first stage refrigeration part 3 and the second stage refrigeration part 4 of the gas cycle refrigerator 1 is not limited to those of the above-described embodiments. For example, in the first stage refrigeration part 3, the tube 15 is connected with the hot end of the first stage regenerator 11 and the hot end of the cylinder 12; however, this tube 15 may be eliminated. Providing the tube 15 has the advantage of decreasing the driving power required for the piston 13, so as to be able to drive the shaft of the piston with the small motor 33 as described above.

Furthermore, in the second stage refrigeration part 4, the buffer 25, or the bypass tube 23 may be eliminated. However, providing the buffer 25 or the bypass tube 23 has the advantage of further improving the refrigeration performance. Although the orifices 26 and 27 are provided at the bypass tube 23 and the tube 24 in the above-described embodiment, a valve may be used instead. Similarly, a small tube may be used to set the flow if optimization further eliminates the need to change the flow. Although the buffer 25 is not limited to being connected to the hot end of the pulse tube 22, providing the buffer 25 in the second stage refrigeration part 4 decreases the volume of gas entering the buffer 25 because of low temperature, and has an added advantage of decreasing the required capacity of the buffer 25.

Figure 6:
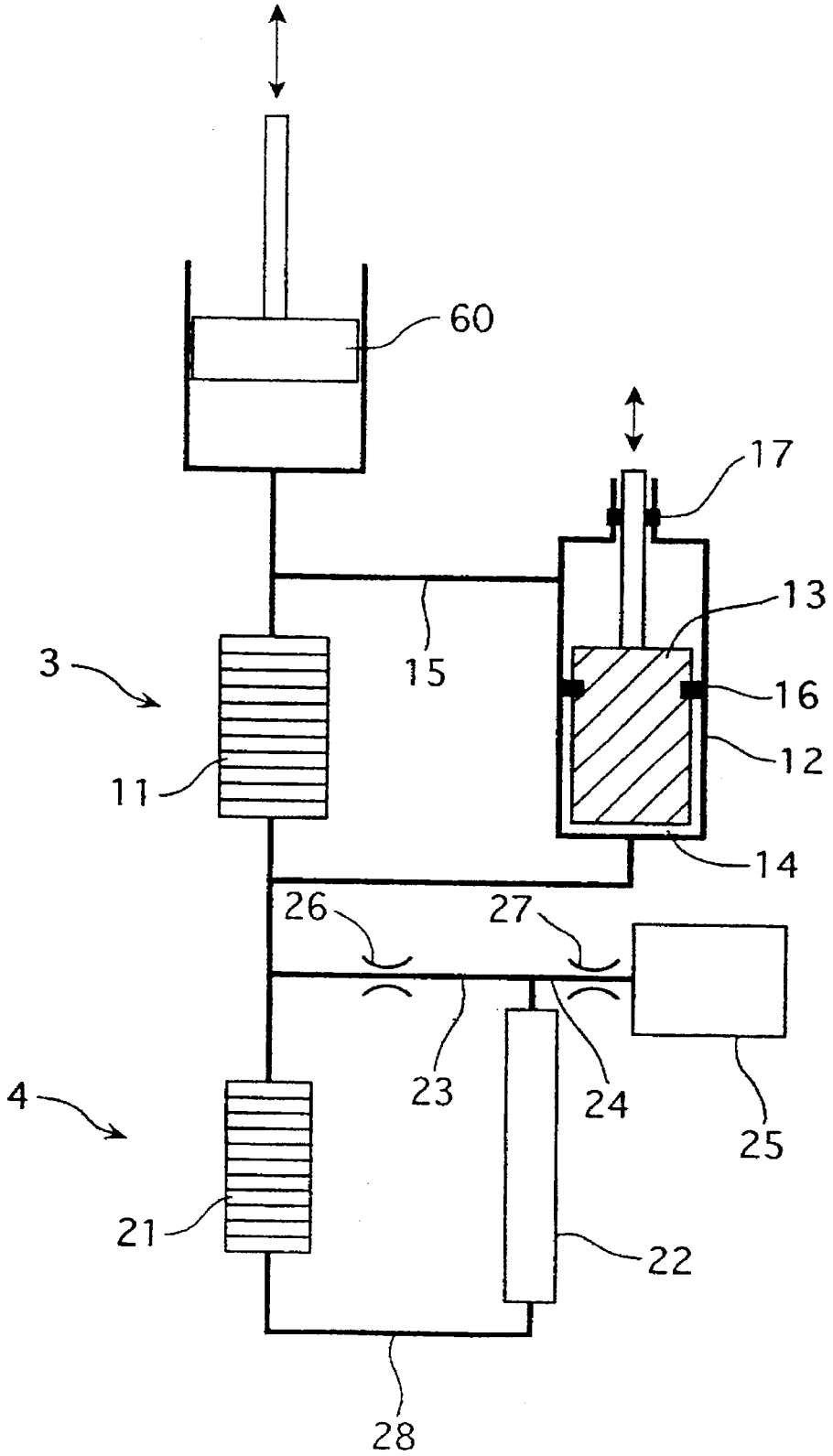
FIG. 6 is a block diagram depicting another modification of the gas cycle refrigerator of the present invention.

The generator 2 for varying refrigerant gas pressure is not limited to one which consists of the compressor 5, and valves 6 and 7, but may be one which generates pressure fluctuation utilizing a compression piston 60, FIG. 6, similar in operation to a Stirling cycle refrigerator, either of which may be appropriately selected at the time of the actual application.

Furthermore, for the regenerators 11 and 21, mesh material of a copper alloy, lead particles, or a mixture of lead particles and Er3Ni (Erbium 3 nickel) may be used, either of which may be appropriately set up according to the required performance of the regenerators 1i and 21. Although the above-described embodiment is a two-stage gas cycle refrigerator 1 with the first stage refrigeration part 3 and the second stage refrigeration part 4, it may be configured as a gas cycle refrigerator with more than three stages. For example, by providing the G-M cycle refrigerator at the head of the first refrigeration part 3, an arrangement like this can refrigerate the substance to be cooled at a different temperature (a higher temperature than that of the second stage refrigeration part 4), at a different temperature from the refrigeration temperature in the second stage refrigeration part 4, also, in the first stage refrigeration part 3, and is suitable for the occasion when the substance to be refrigerated is cooled at multiple stages from different temperatures.

EXPERIMENTAL EXAMPLES

Figure 7:
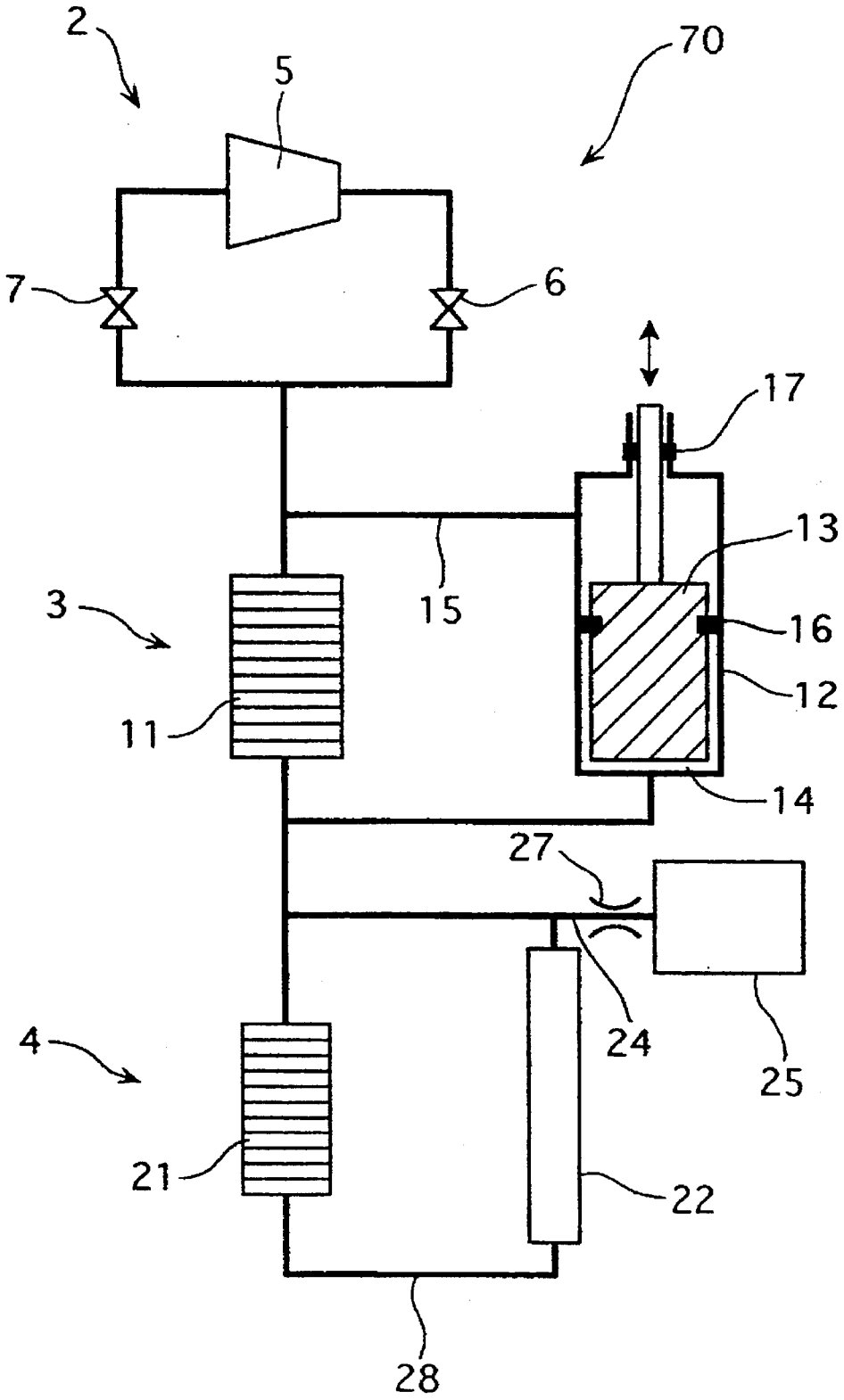
FIG. 7 is a block diagram depicting another modification of the gas cycle refrigerator of the present invention.

This experiment was done to measure the refrigeration performance of the gas cycle refrigerator 1 illustrated in FIG. 2 and that of the gas cycle refrigerator 70, illustrated in FIG. 7, which eliminates the tube 23 and connects only the buffer 25 to the hot end of the pulse tube 22. The materials and sizes of the refrigerators used are described in Table 1.

TABLE 1

Description of the refrigerator used in this study

| Component | Materials | Size (mm) |
|---|---|---|
| First stage displacer | Bakelite filled with 250 no. bronze mesh 75% in volume and lead shot 25% in volume | O.D. 70 reciprocating with 31.8 stroke |
| Second stage regenerator | Stainless steel tube filled with Er3Ni and lead shot (half and half) | $\phi 25 \times 0.5 \times 200$ |
| Second stage pulse tube | Stainless steel tube | $\phi 13 \times 0.5 \times 200$ |
| Orifice | Stainless steel capcillary tube | Length 60, I.D. changeable |
| Bypass tube | Stainless steel capillary tube | Length 40, I.D. changeable |
| Reservoir | Copper | Volume 0.283 L |

The refrigeration performance of the second stage pulse tube 22 is optimized by making the inner diameters of the orifices 26 and 27 changeable, that is, making the flow resistance of the tubes 23 and 24 changeable.

Figure 8:
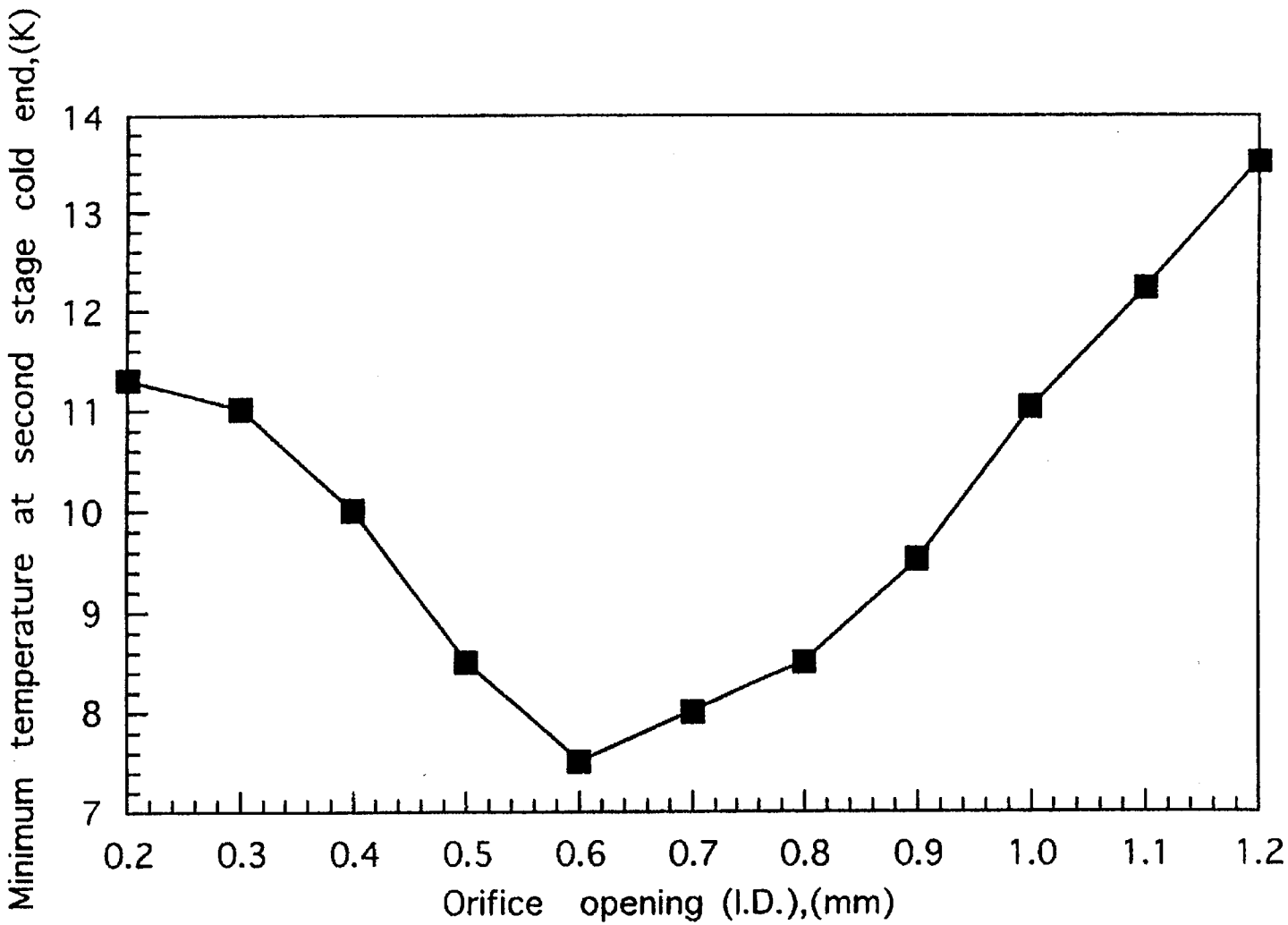
FIG. 8 is a graph depicting experimental results of the gas cycle refrigerator of FIG. 7.

The experiment was conducted using the gas cycle refrigerator 70 illustrated in FIG. 7 with the simple opening type (without a bypass tube) connecting the second stage pulse tube 22. FIG. 8 illustrates the variation of the lowest temperature at the low temperature end (the cold end, that is, the heat station 28) of the pulse tube 22 when the inner diameter of the opening of the orifice 27 at the tube 24 is changed. As FIG. 8 illustrates, the gas cycle refrigerator 70 is optimized with the orifice 27 having an inner diameter opening of 0.6 mm, and in this example the minimum temperature achieved at heat station 28 at the second stage pulse tube 22 was approximately 7.5K.

It is understood that this gas cycle refrigerator 70 has plural advantages, for example, the configuration is simple, and the gas cycle refrigerator 70 is sufficiently fit for actual applications if the required refrigeration performance is approximately 7.5K.

Next, the experiment was conducted with the gas cycle refrigerator 1 having the bypass tube 23 as illustrated in FIG. 2. This gas cycle refrigerator 1 has a potential for having more improved refrigeration performance because with the tube 23 provided, that is, with the double inlet pulse tube type configuration, a phase shift of the pressure and movement of refrigerant gas can be more optimized compared to the gas cycle refrigerator 70.

Figure 9:
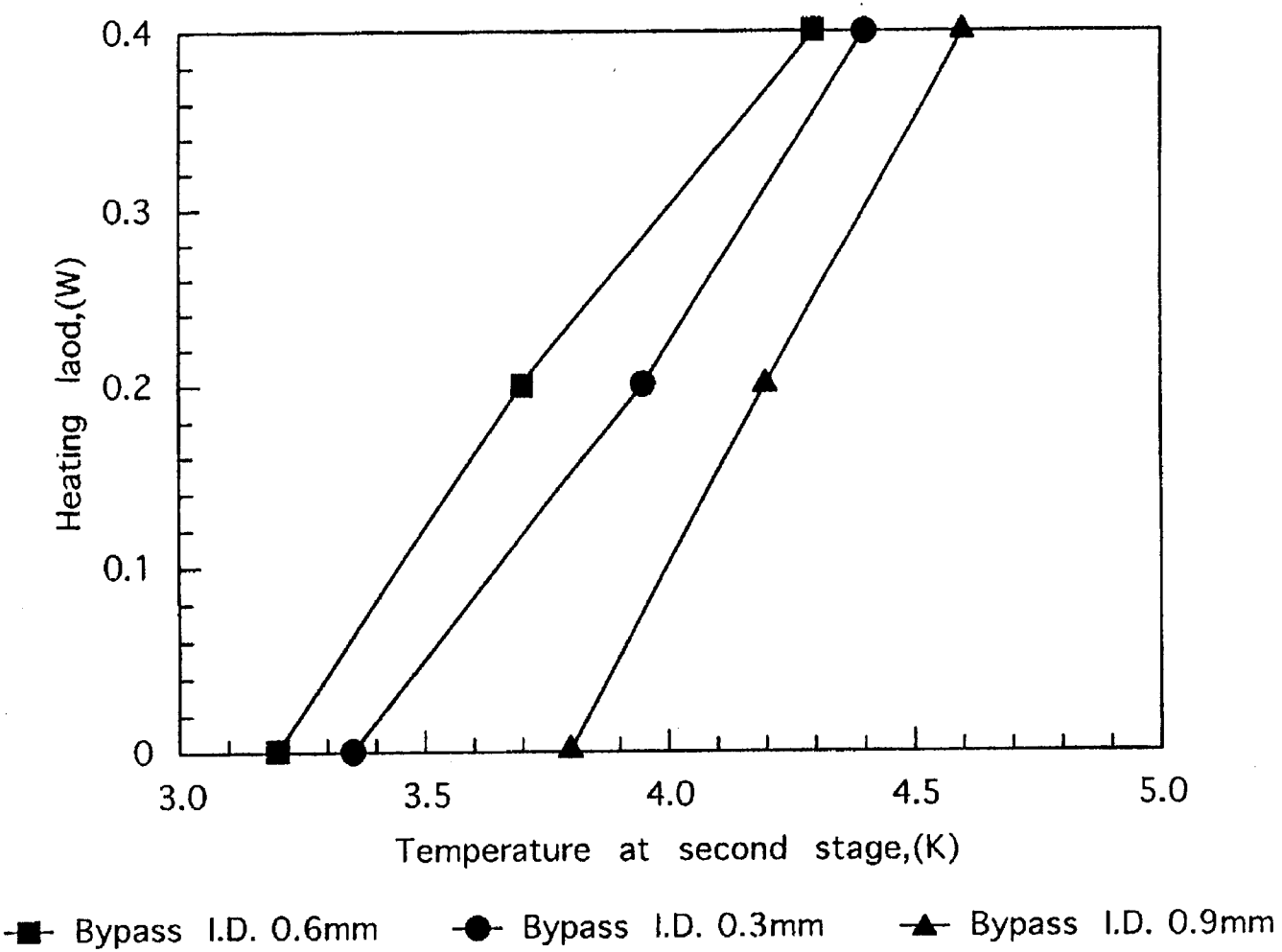
FIG. 9 is a graph depicting experimental results of the gas cycle refrigerator of FIG. 1.
Figure 10:
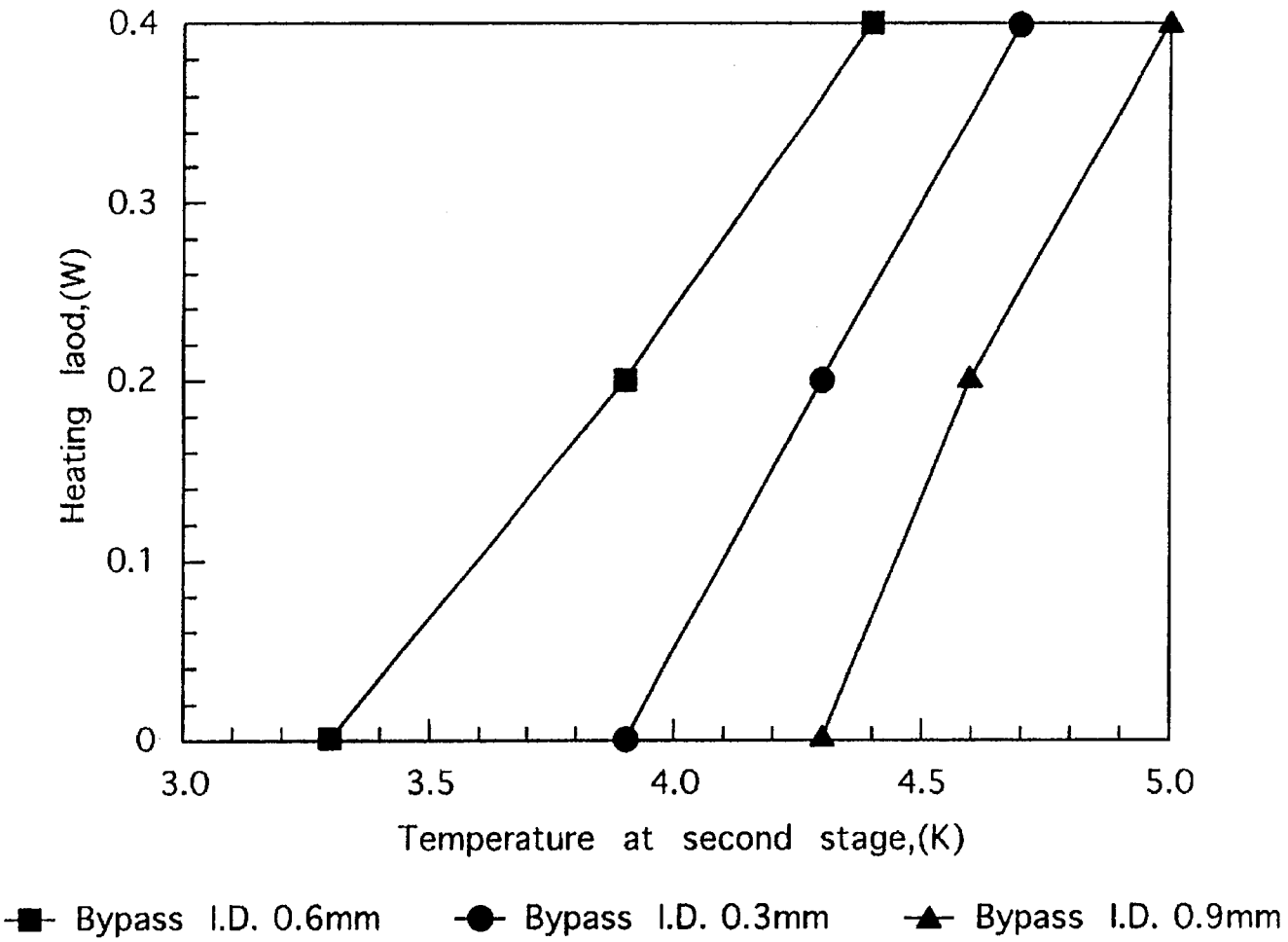
FIG. 10 is a graph depicting experimental results of the gas cycle refrigerator of FIG. 1.

However, because the openings of the orifices 26 and 27 of each tube 23 and 24, respectively, are required to be optimized, an optimum combination of the openings of each orifice 26 and 27 was obtained by the experiment. FIG. 9 shows the minimum temperatures attainable with a 0.3 mm inner diameter of the opening of the orifice 27 of the tube 24 when changing the inner diameter of the opening of the orifice 26 of the tube 23 to 0.3 mm, 0.6 mm, and 0.9 mm. FIG. 10 shows the minimum temperatures attainable with a 0.6 mm inner diameter of the opening of the orifice 27 of the tube 24 when changing the inner diameter of the opening of the orifice 26 of the tube 23 to 0.3 mm, 0.6 mm, and 0.9 mm. The best refrigeration performance which gave a 3.2K minimum temperature was achieved by using the 0.3 mm inner diameter opening of the orifice 27 and the 0.6 mm inner diameter opening of the orifice 26.

In each experiment, the generator 2 for varying refrigerant gas pressure was operated under the same conditions: 0.68 MPa operating low pressure, 2.06 MPa operating high pressure and 1.2 Hz operating frequency.

Figure 11:
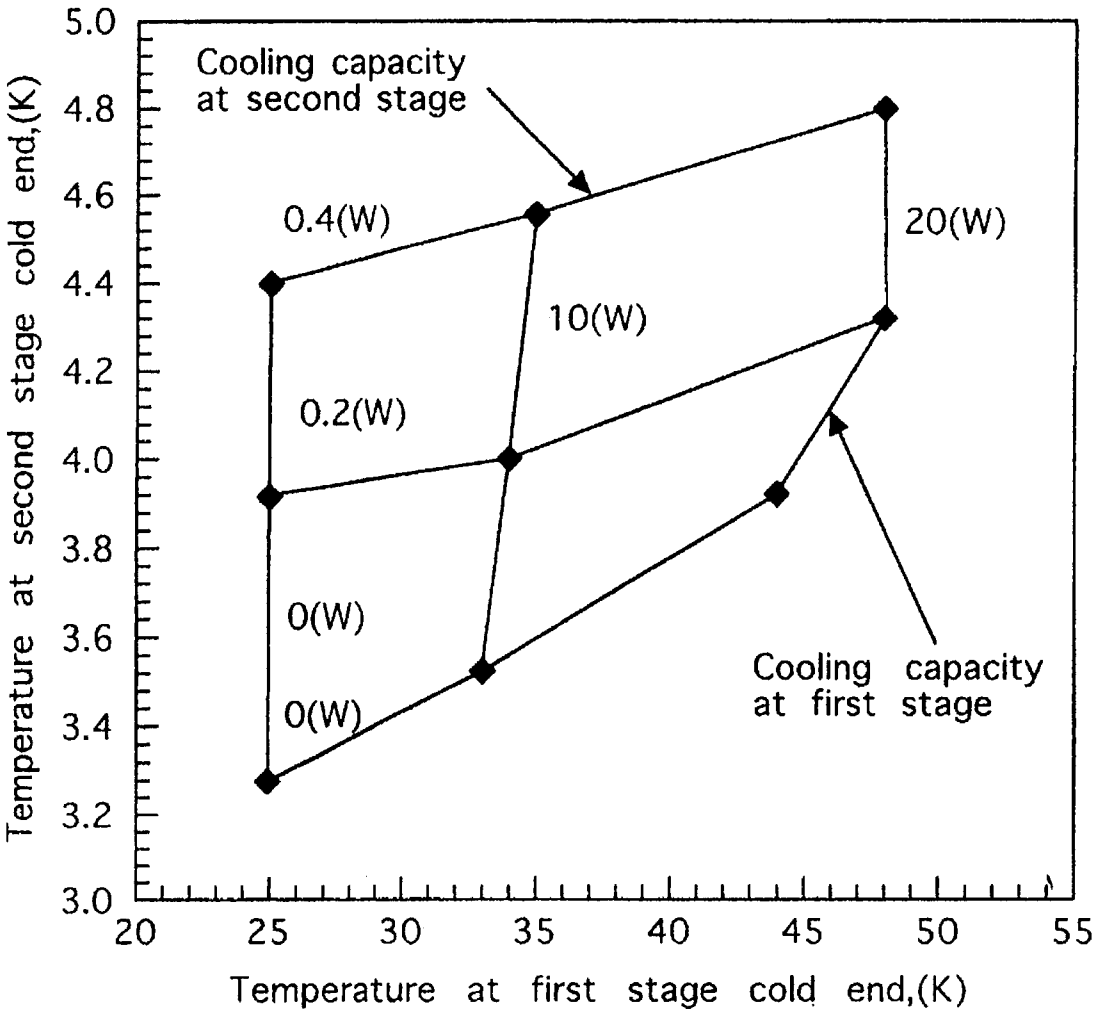
FIG. 11 is a graph depicting refrigeration performance of the gas cycle refrigerator of FIG. 1.

FIG. 11 shows the refrigeration performance of gas cycle refrigerator 1. Each refrigeration performance of the first stage and the second stage was measured by adding the heating load illustrated in the drawings to the low temperature end (cold end). In this case, the openings of each orifice 26 and 27 both have a 0.6 mm inner diameter.

As seen from the experimental results, the two-stage gas cycle refrigerator of the present invention achieves excellent refrigeration performance of less than 4K when optimized with the double inlet type gas cycle refrigerator 1, as well as when utilizing the gas cycle refrigerator 70 of simple configuration a refrigeration performance of less than 8K is achieved.

In summary, the gas cycle refrigerator of the present invention can be a multiple-staged gas cycle refrigerator having improved refrigeration performance. When the second stage refrigeration part consists of the pulse tube type refrigeration part with no moving parts, there is no need to provide a seal at the low temperature part which has a large temperature variation. In this manner a gas cycle refrigerator can be provided at a low price and, at the same time, can be reliably operated without any refrigerant gas leakage. Furthermore, because the first stage refrigeration part consists of a refrigeration part of the type which varies the volume of the expansion room with a piston in a manner similar to the G-M cycle refrigerator, the pressure fluctuation against the second stage refrigeration part is reliably controlled, and the optimum refrigeration performance of the second stage refrigeration part can be predetermined. Thus, the multiple-stage gas cycle refrigerator can be optimized and reliably operated so that the refrigeration performance can be further improved.

What is claimed is:

1. A gas recycle refrigerator, comprising:

a first stage refrigeration part having a first stage regenerator to which refrigerant gas is supplied, a cylinder connected to a cold end of the first stage regenerator, and a piston which is received within the cylinder and varies the volume of an expansion room formed in the cylinder; and a second stage refrigeration part having a second stage regenerator connected to the cold end of the first stage regenerator, and a pulse tube connected to a cold end of the second regenerator.

2. A gas cycle refrigerator according to claim 1, wherein a hot end of the second stage regenerator is connected to a hot end of the pulse tube.

3. A gas cycle refrigerator according to claim 1, wherein the hot end of the pulse tube is connected to a buffer.

4. A gas cycle refrigerator according to claim 3, further comprising a means for adjusting refrigerant flow between the hot end of the pulse tube and the buffer.

5. A gas cycle refrigerator according to claim 1, wherein a hot end of the first stage regenerator is connected to a hot end of the cylinder.

6. A gas cycle refrigerator according to claim 1, further comprising:

a generator for varying refrigerant gas pressure to the first stage regenerator.

7. A gas cycle refrigerator according to claim 6, wherein said generator for varying refrigerant gas pressure has a compressor, high pressure valve and low pressure valve, thereby supplying the refrigerant gas by varying refrigerant gas pressure to a high pressure or a low pressure.

8. A gas cycle refrigerator according to claim 7, wherein said first stage refrigeration part operates as a Gifford-McMahon (G-M) cycle refrigerator.

9. A gas cycle refrigerator according to claim 6, wherein said generator for varying refrigerant gas pressure has a compression piston to supply the refrigerant gas by varying refrigerant gas pressure to a high pressure or a low pressure.

10. A gas cycle refrigerator according to claim 1, wherein the first stage regenerator is concentrically arranged within the piston.

11. A gas cycle refrigerator according to claim 1, wherein the pulse tube is concentrically arranged within the second stage regenerator.

12. A gas cycle refrigerator according to claim 2, further comprising a second stage buffer, wherein a hot end of the second stage regenerator and the hot end of the pulse tube are connected to said buffer.

13. A gas cycle refrigerator according to claim 12, further comprising a means for adjusting refrigerant flow between said hot end of the second stage regenerator and said hot end of the pulse tube.

14. A gas cycle refrigerator according to claim 12, further comprising a means for adjusting refrigerant flow between said hot end of the pulse tube and the buffer.

* * * * *